US005470298A

United States Patent [19]

Curtis

[11] Patent Number: 5,470,298

[45] Date of Patent: Nov. 28, 1995

[54] EXERCISE APPARATUS

[76] Inventor: James L. Curtis, Rte. 2, Box 31, Cameron, Mo. 64429

[21] Appl. No.: 267,861

[22] Filed: Jun. 27, 1994

[51] Int. Cl.[6] ..... A63B 21/04

[52] U.S. Cl. ..... 482/130; 482/57; 482/62; 482/138; 482/72

[58] Field of Search ..... 297/217, 217.1, 297/188.01, 17; 482/123, 129, 100, 112, 90, 73, 128, 905, 130, 72

[56] References Cited

U.S. PATENT DOCUMENTS

| | | | |
|---|---|---|---|
| D. 289,190 | 4/1987 | Brentham . | |
| 2,278,591 | 4/1942 | Sak | 482/73 |
| 3,738,649 | 6/1973 | Miller . | |
| 4,183,520 | 1/1980 | Chase | 482/112 |
| 4,768,775 | 9/1988 | Marshall | 482/73 |
| 4,838,547 | 6/1989 | Sterling . | |
| 4,913,423 | 4/1990 | Farran et al. . | |
| 4,921,247 | 5/1990 | Sterling . | |
| 5,104,363 | 4/1992 | Shi . | |
| 5,242,354 | 9/1993 | Seith, Jr. . | |

*Primary Examiner*—Stephen R. Crow
*Assistant Examiner*—Jerome Donnelly
*Attorney, Agent, or Firm*—Hovey, Williams, Timmons & Collins

[57] ABSTRACT

An exercise apparatus is provided which includes a chair, an arm-exercising station, and a leg-exercising station. The arm-exercising station is mounted in the armrests of the chair and includes a support frame attached to the base portion of the chair, a pair of elongated left and right exercise bars disposed within the left and right armrest portions of the chair operable for selective pivotal movement within the armrest portions, and a resistance device attached to the bars for resisting the pivotal movement of the bars. The leg-exercising station is mounted within the footrest portion of the chair and includes an elongated support bar including a hollow outer pole and an inner pole received in the outer pole for upward telescoping movement, and a pedal assembly attached to the support bar and configured for rotational movement thereabout.

6 Claims, 3 Drawing Sheets

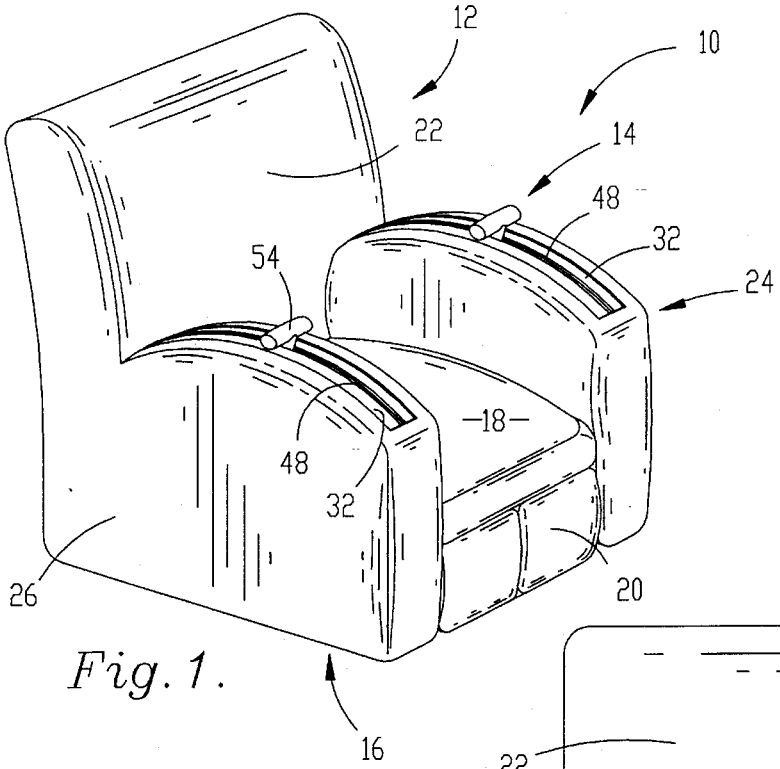
Fig. 1.
Fig. 3.
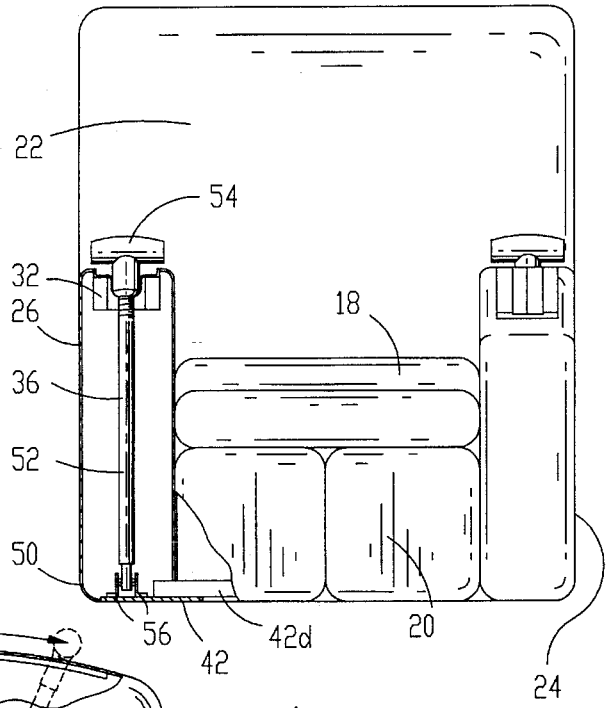
Fig. 2.
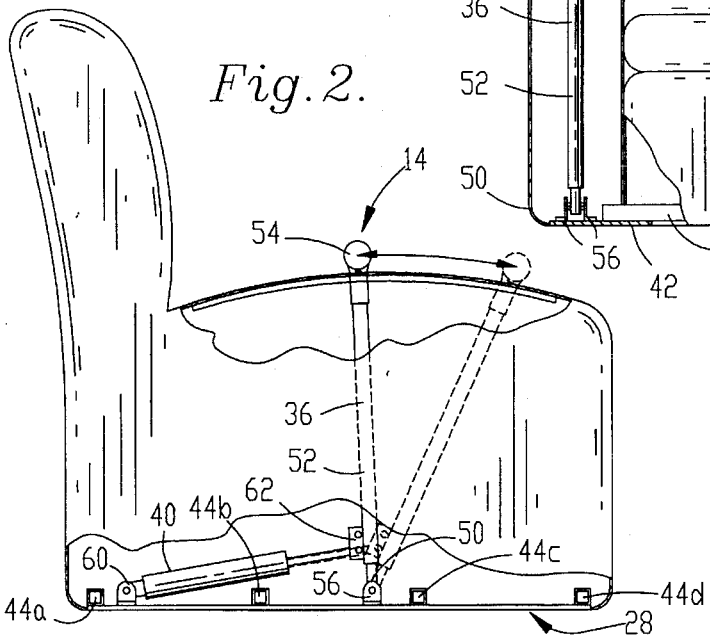

10
114
136
132

154

128
140
144b
144a
144c
142

EXERCISE APPARATUS

BACKGROUND OF THE INVENTION

1. Field of the Invention

The present invention relates generally to exercise equipment and, more particularly, to an exercise apparatus which is incorporated in a piece of furniture such as a chair or recliner.

2. Description of the Prior Art

Due to increased public interest in fitness and health, a great variety of exercise equipment has been designed in recent years. Most exercise equipment includes either a weight-resistance apparatus, a cycle apparatus, or both. Most of these prior art exercise devices are large and bulky and thus require a significant amount of floor space. Moreover, prior art equipment is typically manufactured with numerous moving parts formed of tubular steel or rubber and is thus unsightly. Accordingly, most prior art exercise equipment is primarily designed to be used in commercial fitness centers. Since many users are too busy to travel to fitness centers, commercial exercise equipment is often underutilized.

To meet the demand for more convenient exercise equipment, manufacturers have designed smaller units for residential use. Although these prior art devices are more convenient than large commercial devices, they suffer from many of the same limitations. For example, prior art residential exercisers are unattractive and too large to be placed in living areas of the home. Thus, the equipment is relegated to the basement where it is either used infrequently or totally forgotten.

It is known to design exercise equipment which is incorporated in furniture to improve its appearance and thus increase its use. For example, U.S. Pat. No. 3,738,649 discloses a combined chair and exercising device which has exercise equipment mounted on a platform in a space beneath the seat portion. Although exercise equipment of this type is more convenient than conventional exercise equipment, it presents several disadvantages of its own. For example, prior art furniture exercisers must be set-up before use. In the '649 patent, the user must first get up from the chair and position and lock the exercise platform outside the seat portion of the chair. This operation is cumbersome and time-consuming and thus limits the convenience of the equipment, especially for senior users. Another limitation of prior art furniture exercisers is that they provide limited exercise operations and do not allow the user to exercise his or her upper and lower body simultaneously.

OBJECTS AND SUMMARY OF THE INVENTION

It is an object of the present invention to provide an exercise apparatus which allows the user to effectively exercise his or her upper and lower body simultaneously.

It is another object of the present invention to provide an exercise apparatus which is sized for convenient and attractive use in any room of a residence.

It is another object of the present invention to provide an exercise apparatus which doubles as a useful piece of furniture.

It is another object of the invention to provide an exercise apparatus which can be used without requiring the user to rise from the chair and perform time-consuming and cumbersome set-up procedures.

In accordance with these and other objects evident from the following description of a preferred embodiment of the invention, an exercise apparatus is provided which includes: a chair having a base portion, a seat portion, a footrest portion, a backrest portion, and a pair of left and right armrest portions; an arm-exercising station, and a leg-exercising station.

The arm-exercising station is mounted in the armrests of the chair and broadly includes a support frame attached to the base portion of the chair, a pair of elongated left and right exercise bars operable for selective pivotal movement within the armrest portions, and a resistance device attached to the bars for resisting movement of the bars within the armrest portions of the chair. The exercise bars include a structure which allows the user to adjust the resistance of the resistance device while the exercise equipment is in use.

The leg-exercising station is mounted within the footrest portion of the chair and broadly includes an elongated support bar including a hollow outer pole and an inner pole received in the outer pole for upward telescoping movement, and a pedal assembly attached to the support bar. The pedal assembly is configured for rotational movement and includes a dampening device for providing resistance.

By providing an exercise apparatus with this construction, numerous advantages are obtained. For example, the combination of both a leg and arm exerciser in one piece of exercise equipment provides better fitness conditioning with reduced space requirements. Additionally, since the exercise apparatus doubles as a useful piece of furniture, it can be attractively placed in any area of a home. Accordingly, the exercise apparatus is more convenient and will be used more frequently. Additionally, the user can use the exercise apparatus without first rising from the chair and performing time-consuming and cumbersome set-up procedures. Once again, this increases the convenience and usage of the exercise apparatus. Finally, the construction of the arm-exerciser allows the user to adjust the resistance of the exercise movement "on-the-fly". This also increases the convenience of the exercise apparatus.

BRIEF DESCRIPTION OF THE DRAWINGS

A preferred embodiment of the present invention is described in detail below with reference to the attached drawing figures, wherein:

FIG. 1 is a perspective view of an exercise apparatus constructed in accordance with the preferred embodiment;

FIG. 2 is side view of the apparatus with a portion of the right armrest shown broken away;

FIG. 3 is a front view of the apparatus;

DETAILED DESCRIPTION OF THE PREFERRED EMBODIMENTS

Figures 7, 8, 9, 10:
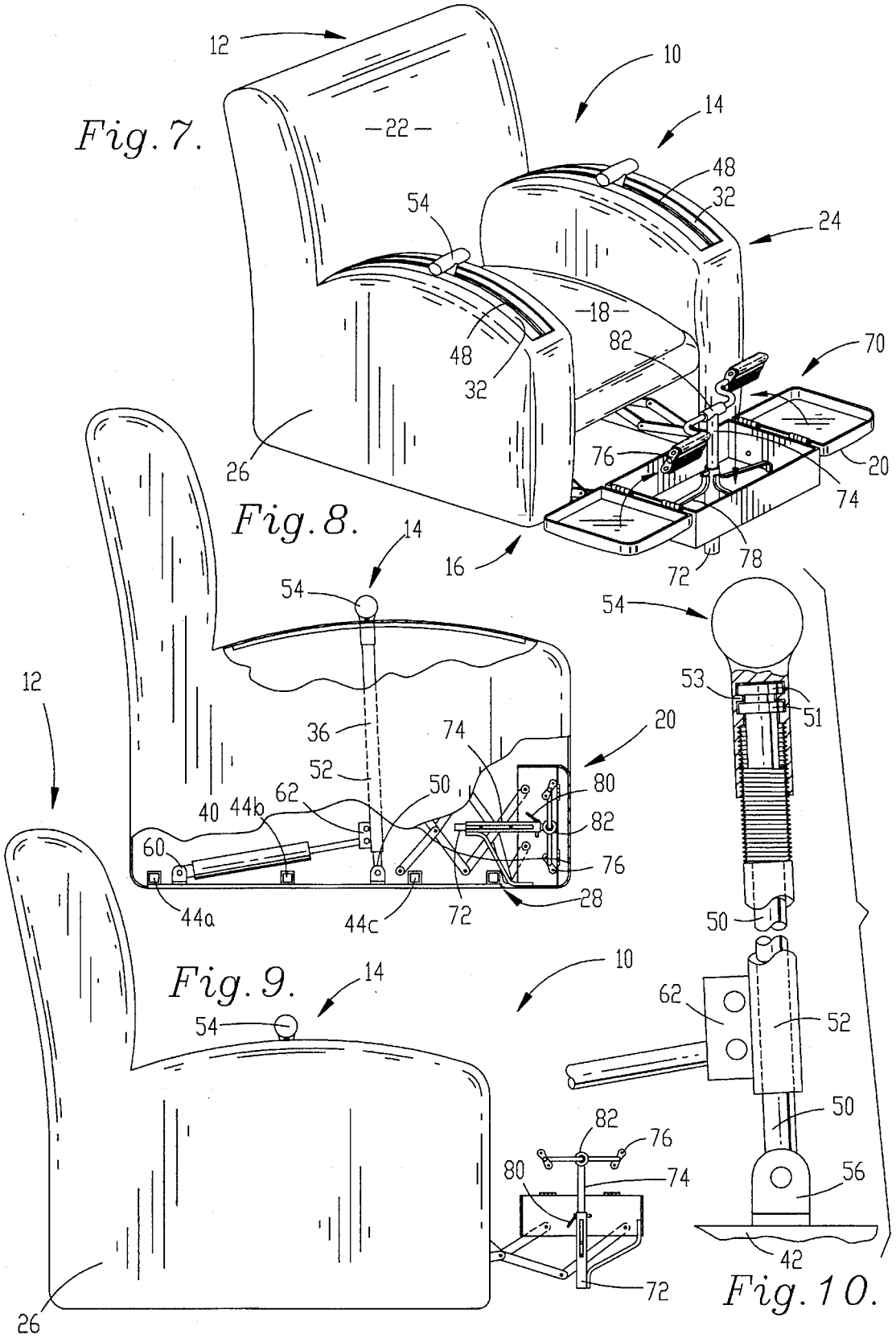
FIG. 7 is perspective view of the apparatus illustrating the leg-exerciser.
FIG. 8 is a side view of the apparatus with a portion of the right armrest shown broken away.
FIG. 9 is side view of the apparatus illustrating the extension of the leg-exerciser.
FIG. 10 is a detail view of the arm-exercising station.

Turning now to the drawings, and particularly FIG. 1, an exercise apparatus 10 constructed in accordance with the preferred embodiment is illustrated. The exercise apparatus 10 broadly includes a chair 12 and an arm-exercising station 14. As illustrated in FIG. 7, the exercise apparatus 10 may also include a leg-exercising station 70.

In more detail, the chair 12 is a conventional chair or recliner and is adapted to cooperate with the components of the arm-exercising station 14 and the leg-exercising station 70 as described in detail below. As best illustrated in FIG. 1, the chair broadly includes a base portion 16, a seat portion 18, a footrest portion 20, a backrest portion 22, and a pair of left and right armrest portions 24 and 26, respectively.

The arm-exercising station 14 is mounted within the armrests of chair 12 and broadly includes a support frame 28, a pair of left and right rubber gussets 32, a pair of elongated left and right exercise bars 36, and a pair of left and right resistance devices 40. The support frame 28 is attached to the chair base portion 16 and provides structural support for the remaining elements of the arm-exercising station 14. The support frame 28 includes a pair of elongated left and right side margins 42 and a plurality of tubular cross members 44*a*, 44*b*, 44*c*, and 44*d*. The side margins 42 are preferably formed of flattened ⅛ inch steel plates and are rigidly attached to each side of the chair base portion 16 by conventional attachment devices. The tubular cross members 44*a–d* are preferably formed of hollow, square tubular steel having an exemplary width of one inch. The cross members are spaced apart and attached intermediate the side margins 42 to form a rigid support frame.

The left and right rubber gussets 32 are conventional elongated reinforcement strips or channels and are mounted on the top of chair armrest portions 24 and 26. As best illustrated in FIG. 1, the gussets 32 define a pair of left and right channels 48 extending substantially the entire length of the armrests. As described in detail below, the channels 48 provide a path for the pivotal movement of the left and right exercise bars 36 within the chair armrests.

The left and right exercise bars 36 are disposed within the chair left and right armrest portions 24 and 26 and are operable for selective pivotal movement therein. The exercise bars 36 are substantially identical, thus only the right exercise bar is described and shown in detail herein. The right exercise bar 36 broadly includes an inner elongated pipe 50, an outer elongated hollow tubular sleeve 52, and a handle 54.

As detailed in FIG. 10, the inner elongated tubular pipe 50 is preferably formed of tubular steel and presents lower and upper opposed ends. The lower end of inner pipe 50 is pivotally supported to the frame right side margin 42 by mounting bracket 56. The pivotal attachment allows the exercise bar 36 to pivot about a horizontal axis extending in a direction perpendicular to the normal direction of a person seated in the chair. Thus, the user can shift the exercise bar in a back and forth motion within channel 48 of armrest 26. The upper end of inner pipe 50 includes a pair of circumferential flanges 51 for securing the handle 54 as described below.

The outer elongated hollow tubular sleeve 52 is also preferably formed of hollow tubular steel but is of a diameter slightly greater than the diameter of the inner pipe 50. The outer sleeve is positioned concentrically around the inner pipe and is configured for axial telescopic movement about the inner pipe. The upper end of the outer sleeve 52 is threaded for engaging the internal threading of the handle 54 as described below. The lower end of the outer sleeve 52 is attached to the resistance device 40 by mounting bracket 62.

The handle 54 is a conventional handle or grip device and is rotatably mounted on the upper ends of the outer sleeve 52 and the inner pipe 50. As illustrated in FIG. 10, the handle 54 includes a base portion including an inwardly extending collar 53 which is sandwiched between the circumferential flanges 51 of the inner pipe 50. Thus, the handle 54 may be rotated freely relative to the inner pipe 50 but cannot move up or down about a vertical axis extending through the inner pipe.

The inner lower portion of the handle 54 is threaded for engaging the external threading of the outer sleeve 52. Thus, when the handle 54 is rotated relative to the inner pipe 50, the outer sleeve 52, which cannot rotate due to mounting bracket 62, telescopes outwardly from the inner pipe 50. This telescopic movement is provided to adjust the resistance of resistance device 40 as described below.

The left and right resistance devices 40 are provided for resisting the pivotal movement of exercise bars 36 within the chair armrest portions. The resistance devices 40 are substantially identical, thus only the right resistance device is described and shown in detail herein. The resistance device 40 is a conventional piston/cylinder assembly including a fixed base portion and a telescopically extending piston rod.

As best illustrated in FIG. 2, the fixed base portion is a conventional hydraulic cylinder assembly and is pivotally supported to the frame right side margin 42 by mounting bracket 60. The piston rod is an elongated metal bar which telescopes in and out of the fixed base portion under tension. The distal end of the piston rod is pivotally supported to the lower end of outer sleeve 52 by mounting bracket 62. The pivotal attachment of the resistance device to the frame and to the outer sleeve prevents the sleeve from rotating but allows it to telescope upwardly from the inner pipe 50.

As described above, the apparent resistance of the resistance device 40 can be adjusted. Clockwise rotation of the handle 54 causes the outer sleeve 52 to telescope upwardly from the inner pipe 50. This upward telescopic movement of the outer sleeve 52 shifts the attachment point of the piston rod upwardly along the vertical axis of the exercise bar. As a result, the apparent resistance to the pivotal movement of the exercise bar is increased because the lever effect about the pivot point is decreased.

In use, the construction of the exercise apparatus 10 provides for a convenient and comfortable exercise operation. The user can operate the arm-exercising station 14 while sitting comfortably in the chair 12 by gripping handles 54 and repetitively pushing and pulling the exercise bars 36. The resistance of the resistance devices 40 can be increased or decreased by rotating the handles 54 in either a clockwise or counterclockwise direction.

Figures 4, 5, 6:
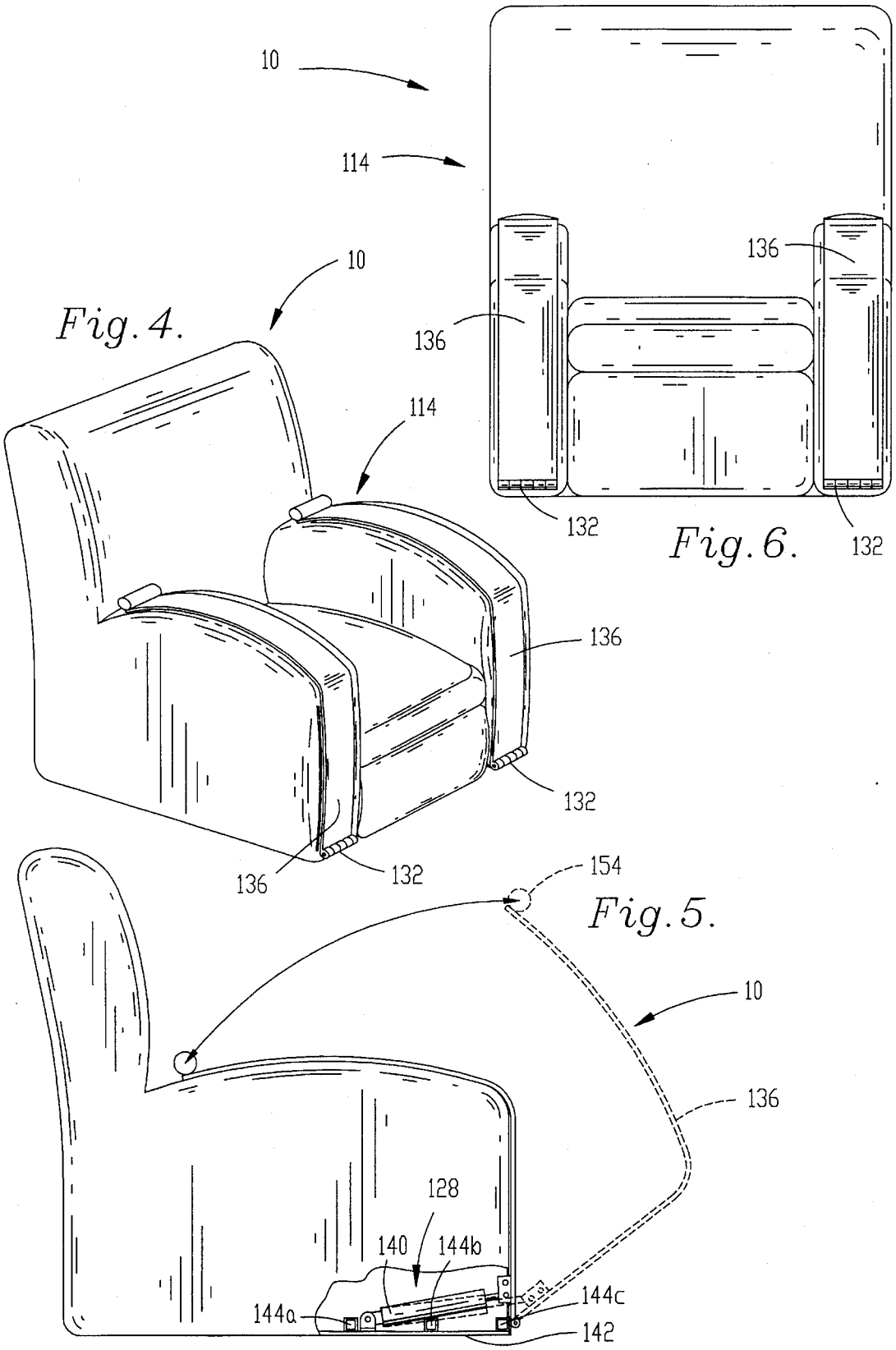
FIG. 4 is a perspective view of an exercise apparatus constructed in accordance with a second embodiment.
FIG. 5 is a side view of the second embodiment of the apparatus.
FIG. 6 is a front view of the second embodiment of the apparatus.

A second embodiment of the arm-exercising station 114 is illustrated in FIGS. 4–6. In this embodiment, the arm exercising station 114 includes a support frame 128, a pair of elongated L-shaped left and right exercise bars 136, and a pair of left and right resistance devices 140.

In more detail, the support frame 128 is attached to the chair base portion 16 and includes a pair of elongated left and right side margins 142 and a plurality of tubular cross members 144*a*, 144*b*, and 144*c*. The side margins 142 are preferably formed of flattened ⅛ inch steel plates and are rigidly attached to the chair base portion 16 by conventional attachment devices. The tubular cross members 144*a–c* are preferably formed of hollow, square tubular steel having an exemplary width of one inch and are spaced apart and positioned intermediate the left and right side margins 142.

The left and right exercise bars 136 are positioned atop the chair armrest portions 24 and 26 and are substantially identical. Right exercise bar 136 is preferably formed of flattened steel and presents a pair of perpendicularly opposed upper and lower L-shaped legs. The lower end of the lower leg is hingedly attached to tubular cross member 144*c* by hinge 132. The pivotal attachment allows the exercise bar to pivot about a horizontal axis extending in a direction perpendicular to the normal direction of a person seated in the chair. The right exercise bar 136 also includes a handle member 154 for gripping by the user.

The left and right resistance devices 140 are provided for resisting the pivotal movement of the exercise bars and are identical to the resistance devices 40 described above.

As illustrated in FIGS. 7, 8 and 9, the preferred exercise apparatus 10 may also include a leg-exercising station 70 mounted within the chair footrest. As illustrated in FIG. 7, the footrest includes walls defining an open rectangular cavity for mounting the components of the leg-exercising station 70. A pair of hinged lids are provided for enclosing the leg-exercising station 70 while the exercise apparatus is being used as a conventional recliner.

The leg exercising station 70 broadly includes an elongated outer support pole 72, an elongated inner support pole 74, and a pedal assembly 76. The outer support pole 72 is preferably formed of hollow tubular steel and extends perpendicularly through the footrest portion 20. The lower end of the outer support pole 72 is positioned to engage the floor surface when the footrest 20 is fully extended. The outer support pole 72 is supported within the footrest 20 by a plurality of L-shaped support braces 78.

The inner support pole 74 is preferably formed of tubular steel, but is of a diameter smaller than the diameter of the outer pole 72. The inner pole 74 is circumferentially received in the outer pole 72 and is configured for axial telescoping movement therefrom. A locking pin 80 is provided for locking the axial position of the inner pole 74 relative to the outer pole 72.

The pedal assembly 76 is a conventional pedal apparatus and is attached to the upper end of inner pole 74. The pedal assembly is configured for rotational movement about a horizontal axis perpendicular to inner pole 74 and includes a rotational motion dampening mechanism 82 for creating a resistance to the rotational movement.

In use, the leg-exercising station 70 allows a user to exercise his or her legs either independently or in conjunction with arm-exercising station 14. The user merely positions himself in chair 12 and extends footrest portion 20 in the conventional manner. Next, the pedal assembly 76 is exposed by opening the footrest hinged lids and positioning the inner pole 74 to a desired height.

Although the invention has been described with reference to the preferred embodiment illustrated in the attached drawing figures, it is noted that equivalents may be employed and substitutions made herein without departing from the scope of the invention as described in the claims.

Having thus described the preferred embodiments of the invention, what is claimed as new and desired to be secured by Letters Patent is:

1. An exercise apparatus comprising:

a chair including a base portion, a seat portion, a footrest portion, a backrest portion, and a pair of left and right armrest portions; and an arm-exercising station including:

a support frame attached to said base portion, an elongated exercise bar disposed within one of said armrest portions and including an inner elongated tubular pipe and an outer elongated tubular sleeve, the tubular pipe presenting upper and lower opposed ends, wherein said lower end is pivotally attached to said support frame so that said exercise bar is operable for selective pivotal movement within said armrest portion, said outer sleeve concentrically surrounding said inner pipe and being configured for relative axial telescopic movement, said tubular sleeve presenting an upper end including external threading, resistance means for resisting movement of said bar within said armrest portion, said resistance means including a piston/cylinder assembly including a fixed base portion attached to said support frame and a telescopically extending piston rod pivotally attached to said tubular pipe lower end, and means for adjusting the resistance of said resistance means, said exercise bar further including a handle member rotatably mounted about the upper ends of said inner pipe and said outer sleeve, said handle member presenting a base portion having internal threading for engaging the external threading of said outer sleeve, wherein rotation of said handle causes said outer sleeve to telescope upwardly from said inner pipe.

2. The exercise apparatus as set forth in claim 1, said arm-exercising station further including a rubber gusset mounted in said armrest portion defining a channel extending substantially the entire length of said armrest portion, wherein said exercise bar is operable for selective pivotal movement within said channel.

3. The exercise apparatus as set forth in claim 1 further including a leg-exercising station mounted within said footrest portion including a pedal assembly fixedly attached to a support bar.

4. An exercise apparatus comprising:

a chair including a base portion, a seat portion and a hollow footrest portion, said footrest portion including walls defining an interior cavity and a hinged top adapted to open to expose said interior cavity;

a leg-exercising station mounted within said footrest interior cavity including an elongated support bar including a hollow outer pole, an inner pole received in the outer pole for upward telescoping movement, and a locking means for locking the axial position of the inner pole relative to the outer pole, and a pedal assembly attached to said support bar and configured for rotational movement thereabout.

5. The exercise apparatus as set forth in claim 4, said pedal assembly including a rotational motion dampening mechanism for creating a resistance to the rotational movement of said pedal assembly.

6. An exercise apparatus comprising:

a frame a seat supported on the frame and facing a first direction; and an arm-exercising station supported on the frame and including an elongated bar having upper and lower ends, the lower end being connected to the frame for pivotal movement about a horizontal axis extending in a direction perpendicular to the first direction;

a resistance means connected between the frame and the bar for providing resistance against pivoting movement of the bar relative to the frame; and an adjustment means supported on the bar for adjusting the resistance provided by the resistance means, the adjustment means including a sleeve supported on the bar for axial translation relative to the bar and a handle supported at the upper end of the bar, the handle and sleeve including threaded sections in engagement with one another so that when the handle is rotated relative to the bar, the sleeve is translated along the bar, the resistance means being connected between the frame and the sleeve so that as the sleeve moves along the bar, the point at which the resistance of the resistance means is exerted on the bar is varied for varying the resistance provided by the resistance means.

* * * * *